US006228483B1

(12) United States Patent
Sarin

(10) Patent No.: US 6,228,483 B1
(45) Date of Patent: May 8, 2001

(54) ABRASION RESISTANT COATED ARTICLES

(75) Inventor: Vinod K. Sarin, Lexington, MA (US)

(73) Assignee: Trustees of Boston University, Boston, MA (US)

( * ) Notice: Subject to any disclaimer, the term of this patent is extended or adjusted under 35 U.S.C. 154(b) by 0 days.

(21) Appl. No.: 08/183,152

(22) Filed: Jan. 18, 1994

Related U.S. Application Data

(63) Continuation-in-part of application No. 07/899,498, filed on Jun. 16, 1992, which is a continuation of application No. 07/553,248, filed on Jul. 12, 1990, now Pat. No. 5,145,739.

(30) Foreign Application Priority Data

Jul. 12, 1991 (EP) ..... 91913975
Jul. 12, 1991 (JP) ..... 3-513336
Jul. 12, 1991 (WO) ..... PCT/US91/04923

(51) Int. Cl.[7] ..... B22F 3/00

(52) U.S. Cl. ..... 428/336; 57/307; 57/309; 628/212; 628/472; 628/698; 628/699; 428/701

(58) Field of Search ..... 428/698, 699, 428/472, 336, 701, 702, 212; 51/307, 309

(56) References Cited

U.S. PATENT DOCUMENTS 3,909,895 * 10/1975 Abrahamsol et al. ..... 76/101
4,150,195 * 4/1979 Tobioka et al. ..... 75/203

(List continued on next page.)

FOREIGN PATENT DOCUMENTS

0138228 * 4/1985 (EP) .
0263747 * 4/1988 (EP) .
0328084 8/1989 (EP) ..... C23C/28/00
2179678 * 3/1987 (GB) .
48-32734 5/1973 (JP) .
51-66289 6/1976 (JP) .
56-152541 * 11/1981 (JP) .
58-209554 12/1983 (JP) .

OTHER PUBLICATIONS

"Production and Properties of Wear–Resistant Coatings With the Aid of Plastic–Bonded Hard Metal/Solder Shapes", Krappitz et al., Conference: Welding and Cutting 1988, *Deutscher Verband fur Schweisstechnik*, pp. 45–49 (1988). (no month).

"A Unique Alternative to Carbide, Tool Steel and Flame Sprayed Wear Surfaces", Reeder, *Powder Metallurgy International*, 19, p. 39 (1987). (no month).

"New Materials in Plant Construction for the Gas and Petroleum Industries" Belousov, *Chemical and Petroleum Engineering*, 10, p. 230 (1974). (no month).

(List continued on next page.)

*Primary Examiner*—Archene Turner
(74) *Attorney, Agent, or Firm*—Samuels, Gauthier & Stevens, LLP

(57) ABSTRACT

A coated article for tribological applications, for example a cutting tool for machining titanium and its alloys. The densified substrate of the article is a cemented carbide, nitride, or carbonitride, or ceramic and may include cubic carbides. A composite coating is codeposited on the substrate to provide a wear surface including no cubic carbides to a depth at least sufficient to avoid exposure of cubic carbides to a workpiece during machining. The coating is a pore-free, dense, hard phase/cobalt composite applied by CVD or PVD, the hard phase including tungsten carbide, nitride, or carbonitride. The cutting tool thus possesses good shape retention at high machining speeds and provides wear-resistance and chemical inertness.

16 Claims, 1 Drawing Sheet

U.S. PATENT DOCUMENTS

| | | | | |
|---|---|---|---|---|
| 4,252,862 | * | 2/1981 | Nishida | 428/477 |
| 4,359,335 | * | 11/1982 | Garner | 428/698 |
| 4,406,667 | | 9/1983 | Sarin et al. . | |
| 4,406,668 | | 9/1983 | Sarin et al. . | |
| 4,406,669 | | 9/1983 | Sarin et al. . | |
| 4,406,670 | | 9/1983 | Sarin et al. . | |
| 4,409,003 | | 10/1983 | Sarin et al. . | |
| 4,409,004 | | 10/1983 | Sarin et al. . | |
| 4,416,670 | | 11/1983 | Sarin et al. . | |
| 4,421,525 | | 12/1983 | Sarin et al. . | |
| 4,424,066 | | 1/1984 | Sarin et al. . | |
| 4,426,209 | | 1/1984 | Sarin et al. . | |
| 4,431,431 | | 2/1984 | Sarin et al. . | |
| 4,435,480 | * | 3/1984 | Mizuhara | 428/699 |
| 4,440,547 | | 4/1984 | Sarin et al. . | |
| 4,441,894 | | 4/1984 | Sarin et al. . | |
| 4,449,989 | | 5/1984 | Sarin et al. . | |
| 4,469,489 | | 9/1984 | Sarin et al. . | |
| 4,497,874 | * | 2/1985 | Hale | 428/551 |
| 4,507,151 | * | 3/1985 | Simm et al. | 75/251 |
| 4,526,618 | * | 7/1985 | Keshavan et al. | 106/1.05 |
| 4,556,607 | * | 12/1985 | Sastri | 428/627 |
| 4,588,606 | * | 5/1986 | Keshavan et al. | 427/34 |
| 4,698,266 | * | 10/1987 | Buljan et al. | 428/457 |
| 4,701,384 | * | 10/1987 | Sarin et al. | 428/689 |
| 4,702,970 | * | 10/1987 | Sarin et al. | 428/698 |
| 4,705,124 | * | 11/1987 | Abrahamson et al. | 175/410 |
| 4,710,425 | | 12/1987 | Baldoni, II et al. . | |
| 4,745,010 | * | 5/1988 | Sarin et al. | 427/255 |
| 4,749,629 | * | 6/1988 | Sarin et al. | 428/698 |
| 4,844,951 | * | 7/1989 | Sarin et al. | 427/255 |

OTHER PUBLICATIONS

"Characterisation and Wear Performance of Plasma Sprayed WC–Co Coatings" Ramnath et al., *Materials Science and Technology*, 5, p. 382 (1989). (no month).

"A Technical Assessment of High Velocity Oxygen–Fuel Versus High Energy Plasma Tungsten Carbide–Cobalt Coatings for Wear Resistance" Dorfman et al., Conference: Thermal Spraying, *The Welding Institute*, 2, p. 291 (1989). (no month).

"High Stress Abrasion of Carbidic Hardfacing Alloys", Leech, *Surface Engineering*, 5, p. 41 (1989). (no month).

"Cemented Carbide Cutting Tools", Sarin, Advances in Powder Technology, *Materials Science Seminar*, Louisville, Kentucky, ed. Gilbert Y. Chin, p. 253 (1981). (no month).

"Tribological Properties of Ion Plated Coatings", Berger et al., IPAT 89—Ion and Plasma Assisted Techniques—7th International Conference, p. 262 (1989). (no month).

"Application and Manufacture of CVD Hard–Facing Layers for Cutting and Non–Cutting Shaping", Schintlmeister et al., *Metall.*, 34, pp. 905–909 (1980). (no month).

"Peculiarities of Wear Behaviour of Coated Cemented Carbides", Berger et al., Fifth Polish Conf. on Powder Metallurgy (Proc. Conf.) Poznan, Poland, (III) pp. 71–90, (1979). (no month).

"The Results of Roughness and Wear Tests on Wear–Resistant Coatings" Habig et al., *Hart.–Tech. Mitt.*, 40, pp. 283–295 (1985). (no month).

Barbezat et al "Applying Tungsten Carbide Cobalt Coatings by High Velocity Combustion Spraying" Sulze Technical Review 1988 p.4–10.*

Moustakas et al "Growth & Structure of Tungsten Carbide—Transaction Metal Superlattices" Mat. Res. Sec. Sym. Proc. vol. 103 1988 p 41–46.*

Parry et al "Wear Resistant Coatings Made by Chemical Vapors Deposition Structures" Materials Pand of AGARP 1980 p 10–1 –10–12.*

Rudy et al HFN Coatings for Cemented Carbides and New Hard Facing Alloys on the Basis (Mo., WX–Mo, IV)C Plansooberorichte 26, p 105 (1978).*

* cited by examiner

ABRASION RESISTANT COATED ARTICLES

This is a continuation-in-part of copending application Ser. No. 07/899,498 filed Jun. 16, 1992, which is a continuation of Ser. No. 07/553,248, filed Jul. 12, 1990, now U.S. Pat. No. 5,145,739.

BACKGROUND OF THE INVENTION

The invention relates to abrasion resistant coated articles, for example, cutting tools.

Metal cutting and other wear applications require cutting tools and abrasive materials with particular surface and bulk properties. The tool surface must be chemically inert and resistant to mechanical wear, while the bulk material must be tough and resistant to plastic deformation, as well as to crack generation and propagation. These requirements have been satisfied by substrate and applied coating optimization.

Titanium and its alloys present particular challenges for cutting tool design. Titanium is characterized by a low thermal conductivity, a low specific heat, and a high melting point. These properties result in high cutting temperatures even at moderate cutting speeds. Furthermore, titanium displays high chemical reactivity at these high cutting temperatures. To date, no coated cutting tool has been found to be satisfactory for titanium machining. Currently, the best available tool material for titanium machining is cemented tungsten carbide cobalt (WC—Co), which maintains shape integrity only at extremely low cutting speeds. Cutting tools are needed capable of machining titanium and other hard to machine materials at high speeds and feed rates. The invention described herein was developed to address this need.

SUMMARY OF THE INVENTION

In one aspect, the present invention provides for coated articles for tribological applications including substrates to which hard phase/binder composite coatings have been applied to provide a wear surface. The substrate includes a cemented carbide, cemented nitride, cemented carbonitride, ceramic, or combinations thereof. A coating about 1–50 $\mu$m, preferably about 1–25 $\mu$m, most preferably about 5–15 $\mu$m thick is deposited on the substrate and provides the wear surface. The coating includes a pore-free, dense, hard phase/cobalt binder composite, the hard phase including tungsten carbide, nitride, or carbonitride. The wear surface includes no cubic carbides to a depth at least sufficient to avoid exposure of cubic carbides to a work-piece during use of the article in tribological applications, so that the coated article provides wear-resistance and chemical inertness and possesses good shape retention at high machining speeds.

The hard phase/cobalt composite of the coatings described herein is a material consisting of particles of tungsten carbide, nitride, or carbonitride interconnected in a cobalt binder. The term "cobalt binder" designates a cobalt or cobalt-based alloy by which hard phase particles are cemented together. As used herein, the term "hard phase particles" can refer to any of a variety of shapes, e.g., a particulate, rod, disk, or whisker morphology, or a combination of such shapes. Typical cemented substrates include cemented refractory metal carbides, nitrides, or carbonitrides. Typical ceramic substrates include ceramics based on, e.g., refractory metal carbides, nitrides, or carbonitrides, alumina, silicon nitride, silicon carbide, or zirconia. The cemented carbide, nitride, or carbonitride, or ceramic substrates can include cubic carbide compounds, i.e., carbides having a cubic crystal structure in an amount up to 50 volume percent. Such carbides include carbides of titanium, zirconium, hafnium, vanadium, niobium, tantalum, and molybdenum. Other metal compounds having a cubic crystalline microstructure are similarly reactive, and present a problem when they contact such titanium containing workpieces at high machining speeds. Such other cubic compounds include, e.g., cubic nitrides and carbonitrides of titanium, tantalum, hafnium, etc. Thus as used herein, the term "cubic carbides" is intended to refer to such other compounds having a cubic crystalline microstructure as well as to the described carbides themselves.

In a narrower aspect, the coated article is a tungsten carbide/cobalt/cubic carbide (WC—Co-$\gamma$) substrate coated with tungsten carbide/cobalt (WC—Co). In another narrower aspect, the coated article is a monolithic or composite ceramic material with a sintering aid in an amount between 0 percent and an amount sufficient to densify the ceramic material to a preselected density. The ceramic material may be, for example, a hard refractory carbide, nitride, or carbonitride of titanium, zirconium, hafnium, vanadium, niobium, tantalum, chromium, or molybdenum, or may be based on silicon nitride, silicon carbide, alumina or zirconia.

BRIEF DESCRIPTION OF THE DRAWINGS

For a better understanding of the present invention, together with other objects, advantages, and capabilities thereof, reference is made to the following Description and appended claims, together with the Drawings in which:

DETAILED DESCRIPTION OF THE PREFERRED EMBODIMENTS

Figure 1:
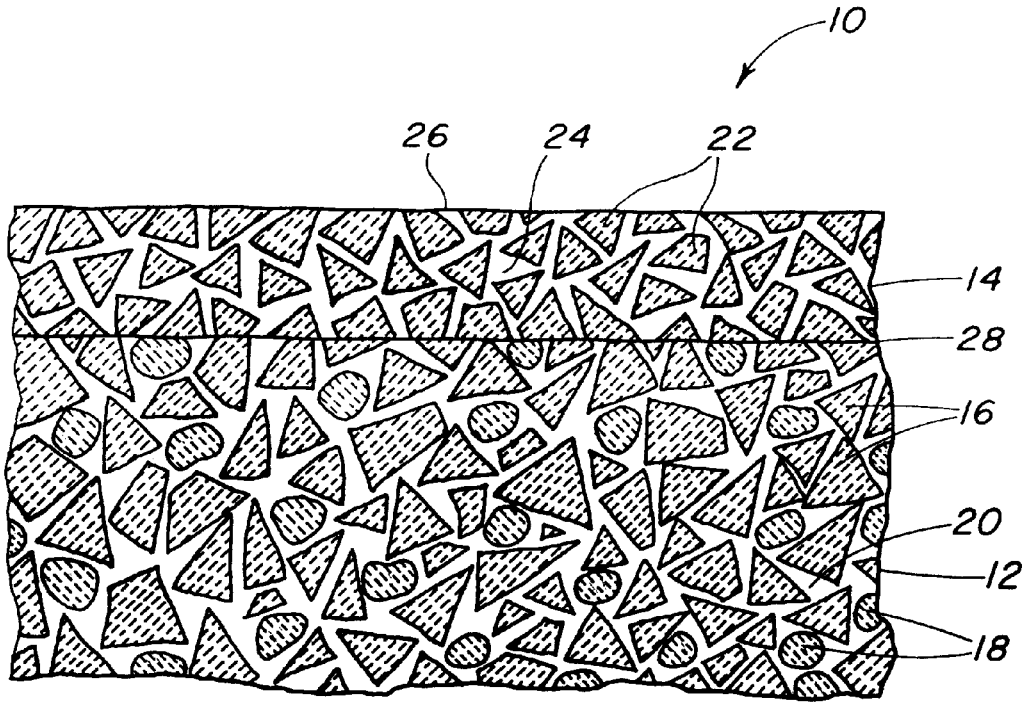
FIG. 1 is a schematic representation, in cross-section, of a tungsten carbide/cobalt (WC—Co) composite coated tungsten carbide/cobalt and cubic carbide (WC—Co-$\gamma$) composite article.

Careful selection of substrate material and applied coating can aid in the design of highly abrasion resistant articles useful for, e.g., machining of titanium and its alloys and other difficult to machine materials.

In an exemplary article, the substrate is a cemented hard refractory carbide, nitride, or carbonitride of titanium, vanadium, chromium, zirconium, niobium, molybdenum, hafnium, tantalum, tungsten, or combinations of these elements, the hard refractory particles being cemented in a matrix of a metal binder such as nickel, cobalt, tungsten, molybdenum, or alloys of these elements. For machining applications, the metal binder typically is present in such cemented materials in an amount of 3–15 weight percent (w/o). In other embodiments, the substrate can be a monolithic or composite refractory ceramic such as the carbides, nitrides, or carbonitrides of titanium, vanadium, chromium, zirconium, niobium, molybdenum, hafnium, tantalum, or tungsten; or silicon nitride, aluminum oxide, partially stabilized zirconia (PSZ), or transformation toughened zirconia (TTZ). The ceramic material may include sufficient densification or sintering aid to densify the ceramic to the desired density.

A typical thickness for a single layer of the composite coating is in the range of about 1–50 $\mu$m, preferably about 1–25 $\mu$m, most preferably about 3–15 $\mu$m. The residual stresses arising from a mismatch in coefficients of thermal expansion between a coating and its substrate can affect the adherence of the coating, and thus the machining performance of the cutting tool. Although a certain thickness of coating may be required to provide a wear surface for tribological applications, thinner coatings, e.g. the above preferred and most preferred thicknesses, can reduce the residual stresses inherent in such coated articles.

Deposition of, e.g., a WC-binder coating on a specifically engineered substrate, for example a ceramic or WC—Co-γ substrate, can be used to fabricate cutting tools with improved high temperature stability, resistance to tool nose deformation and abrasion, good shape retention at high machining speeds and temperatures, and chemically inert surfaces. By selectively exploiting the differing characteristics of specific substrates coated with the composite coatings described herein, it is possible to design cutting tools meeting the demands of particular machining tasks, for example machining of titanium or titanium alloys, which are highly chemically reactive with cubic carbides at the high temperatures resulting from high speed machining. In particular, the cemented or ceramic substrates described herein which include cubic carbides can be highly chemically reactive with titanium and titanium alloy workpieces. However, the codeposited coatings described herein shield such a workpiece from contact with the substrate and from the cubic carbides therein.

Although the above discussion mentions only cubic carbides as being reactive with titanium and titanium alloys, other metal compounds having a cubic crystalline microstructure are similarly reactive, and present a problem when they contact such titanium workpieces at high machining speeds. As mentioned above, such other cubic compounds include, e.g., cubic nitrides and carbonitrides of titanium, tantalum, hafnium, etc., and are also included in the term "cubic carbides" as used herein.

In a typical embodiment, shown in FIG. 1, abrasion resistant article 10 includes substrate 12 having composite coating 14 deposited thereon. Substrate 12 is a composite material including tungsten carbide particles 16 and tantalum carbide particles 18 bonded by matrix 20 of cobalt, forming a tungsten carbide/cobalt/cubic carbide (WC—Co-γ) composite. As heretofore mentioned, during high speed machining, titanium and titanium alloy workpiece materials are highly chemically reactive with the cubic carbides of a cutting tool of the composition of substrate 12. However, coating 14 shields such a workpiece material (not shown) from contact with substrate 12 and from the cubic carbide therein.

Coating 14 is also a composite material, and includes tungsten carbide particles 22 codeposited with cobalt binder 24 which forms the matrix of the composite of coating 14. The codeposition of the tungsten carbide hard phase and the cobalt binder, e.g. by CVD, provides a homogeneous, dense coating including no cubic carbides. For some applications, coating 14 can include a lower weight percent of cobalt than substrate 14, providing a relatively tougher substrate and a relatively harder cutting surface. However, the specific cobalt binder/tungsten carbide (or other hard phase) ratio in the coating is selected to tailor the coated article for a particular application, with a relatively higher Co:WC ratio providing increased coating toughness and a lower ratio providing increased wear resistance.

As stated above, coating 14 includes no cubic carbides. Therefore, at high temperatures the wear surfaces, as 26, of article 10 are much less chemically reactive with titanium-containing workpiece materials. Thus, substrate 12 provides for high temperature shape stability while coating 14 is not only wear resistant, but is very chemically stable. These qualities combine to yield an abrasion resistant coated article suitable as a cutting tool for high speed machining, even of such highly reactive materials as titanium and titanium alloys. Such a tool maintains its shape integrity and chemical stability during high speed and high feed rate machining of such difficult to machine materials.

The abrasion resistant coated articles described herein may be engineered for different machining applications. For example, in other embodiments substrate 12 may be a monolithic or composite ceramic material, for example, silicon nitride ($Si_3N_4$), aluminum oxide ($Al_2O_3$), or yttria stabilized zirconia (YSZ), optionally with suitable sintering aids included to achieve the desired density. Alternatively, an intermediate layer (not shown) may be deposited between cemented or ceramic substrate 12 and coating 14. In the case of a ceramic substrate, an intermediate layer may include, e.g., aluminum nitride, aluminum oxynitride, titanium carbide, titanium nitride, or titanium carbonitride to reduce stresses due to coefficient of thermal expansion mismatch and to enhance adhesion. An intermediate layer may include cubic carbides, and/or may have a weight percent cobalt intermediate those of cemented substrate 12 and coating 14. Also alternatively, coating 14 itself may be progressively changed in composition during codeposition to include cubic carbides and/or a higher cobalt content at interface 28 of article 10 (or at the interface between coating 14 and the intermediate coating layer), gradually changing in composition to provide the desired surface characteristics. However wear surface 26, in all embodiments, is free of cubic carbides, preferably to a depth sufficient to prevent exposure of cubic carbides at wear surface 26 during the expected life of the tool. As mentioned above, although the binder of coating 14 is cobalt, the binder of matrix 20 may be a metal or metal alloy other than cobalt, for example nickel, tungsten, molybdenum, or alloys of these elements or cobalt. The combination of substrate and coating compositions is optimized according to the application and the material to be cut.

A chemical vapor deposition (CVD) process may be used to produce the above-described tungsten carbide, nitride, or carbonitride/binder composite coatings. In a chemical vapor deposition process for a tungsten carbide/cobalt composite, gas sources of tungsten, carbon, and cobalt, along with hydrogen are reacted at the surface of a heated substrate to deposit the tungsten carbide/cobalt composite coating. Preferred carbon sources are methane and propane. For other metal carbide deposition, a source of the desired metal is substituted for the tungsten source. Preferred nitrogen sources for a corresponding metal nitride/cobalt composite CVD process are ammonia and nitrogen. For a metal carbonitride/binder composite CVD process, reactant gases include both nitrogen and carbon containing gases, preferably ammonia or nitrogen, and methane or propane, respectively.

The gaseous tungsten source can be a tungsten halide compound and the gaseous cobalt source can be a cobalt halide compound. Methane can be used as a carbon containing gas. The deposition reaction can be conducted on a substrate surface heated to a temperature in the range 400–1500° C. and at pressures ranging between atmospheric pressure and 5 torr. The reaction temperature is selected based upon the substrate properties and the maximum temperature which the substrate can withstand.

The composition of the coating, e.g. the carbide:cobalt ratio, may be controlled by adjusting the relative partial pressures of component containing gases. A coating having a higher binder content at the substrate/coating interface (or interlayer-coating interface) may be CVD deposited by adjusting the relative partial pressures of binder and tungsten containing gases, either gradually or abruptly, during deposition. Similarly, the above-described coating including cubic carbides in the region near the substrate-coating interface (or interlayer-coating interface) may be CVD deposited by including an appropriate metal source, e.g. a tantalum or titanium halide, in the initial gas mixture, and gradually or abruptly shutting off the flow of this gas before coating deposition is complete, to deposit the desired depth of cubic carbide-free material at the surface of the article.

As described above, interfacial layers can be deposited between substrate and coating by known methods to promote adhesion, for specific substrate coating properties, or for other purposes. Post-deposition processing can be conducted to optimize coating morphology, including particle size and aspect ratio.

The following Examples are presented to enable those skilled in the art to more clearly understand and practice the present invention. These Examples should not be considered as a limitation upon the scope of the present invention, but merely as being illustrative and representative thereof.

EXAMPLE 1

A tungsten carbide/cobalt/titanium carbide (WC—Co-γ) cutting tool blank is heated to a temperature in the range of 600–1200° C., and exposed to a mixture of $WCl_6$, $CH_4$, $H_2$ and $CoI_2$ reactant gases in an inert carrier at pressures between atmospheric pressure and 5 torr. The reactant gases react at the surface of the heated cutting tool blank substrate to codeposit, by chemical vapor deposition (CVD), a 10 μm thick WC—Co composite coating according to the simultaneous reactions $$WCl_6+CH_4+H_2 \rightarrow WC+6HCl \quad (1)$$

$$CoI_2+H_2 \rightarrow Co+2HI \quad (2)$$

The resulting cutting tool has a tungsten carbide/cobalt (WC—Co) composite coating deposited on the substrate, with an insignificant amount of cubic carbides at the substrate/coating interface and no cubic carbides at or near the coating surface.

EXAMPLE 2

The surface of a cutting tool blank of the same composition as that of Example 1 is coated by reacting tungsten fluoride with hydrogen at 600–1200° C. and at a pressure between atmospheric pressure and 5 torr, to deposit a tungsten layer, which is carburized in a hydrogen/methane mixture according to the reaction $$WF_6+CH_4+H_2 \rightarrow WC+6HF \quad (3)$$

Simultaneously, cobalt is deposited by reacting cobalt iodide with hydrogen according to reaction (2) of Example 1. The result is a WC—Co coating 7 μm thick on the cutting tool blank substrate. The coating has an insignificant amount of cubic carbides at the substrate/coating interface and no cubic carbides at or near the coating surface.

EXAMPLE 3

The surface of a silicon nitride based ceramic cutting tool blank including titanium carbide whiskers is coated with a 15 μm thick tungsten carbide/cobalt (WC—Co) coating by CVD reactions (1) and (2) of Example 1. The gases are reacted at the surface of the cutting tool blank substrate heated to a temperature in the range of 700–1500° C. at pressures between atmospheric pressure and 5 torr. The composite coating includes an insignificant amount of cubic carbides at the substrate/coating interface and no cubic carbides at the coating surface.

In other embodiments, a conventional physical vapor deposition (PVD) process such as sputtering or laser ablation may be used to deposit the coating. For example, tungsten carbide, nitride or carbonitride/cobalt composite coatings are deposited by providing a tungsten carbide, nitride, or carbonitride target, a cobalt containing target and an ion or laser source which respectively sputters or ablates these targets. Tungsten carbide, nitride, or carbonitride and cobalt thus are PVD codeposited to form a refractory metal carbide, nitride, or carbonitride/cobalt composite coating.

In still other PVD processes, a target containing tungsten and another target containing a cobalt are sputtered or laser ablated in a carbon, nitrogen, or carbon and nitrogen containing gas atmosphere to deposit a tungsten carbide, nitride, or carbonitride/cobalt composite on the substrate. Preferred nitrogen and carbon containing gases are respectively ammonia or nitrogen and methane or propane.

The invention described herein presents to the art novel, improved coated articles having resistance to chemical degradation at high temperatures, particularly when used as a cutting tool for cutting titanium, titanium alloys, and other difficult to machine workpiece materials. The invention provides particular advantages in that the coating may be applied over ceramics, including those containing cubic carbide components, which readily react with titanium containing workpieces, to provide cutting tools particularly suited to high speed, high feed rate machining of such titanium containing workpieces.

While there has been shown and described what are at present considered the preferred embodiments of the invention, it will be apparent to those skilled in the art that modifications and changes can be made therein without departing from the scope of the present invention as defined by the appended claims.

I claim:

1. A coated article for tribological applications, said article having a wear surface and comprising:

a densified substrate substantially comprising at least one of cemented carbides, cemented nitrides, cemented carbonitrides, ceramics, and combinations thereof; and a coating codeposited on said substrate and providing said wear surface, said coating being about 1–50 μm thick and comprising a pore-free, dense hard phase/cobalt binder composite, said hard phase comprising tungsten carbide, nitride, or carbonitride;

wherein said wear surface includes said hard phase/cobalt binder composite, but includes no cubic carbides to a depth at least sufficient to avoid exposure of cubic carbides to a workpiece during use of said article in said tribological applications, such that said coated article provides wear-resistance and chemical inertness and possesses good shape retention at high machining speeds.

2. A coated article in accordance with claim 1 wherein said coating is about 1–25 μm thick.

3. A coated article in accordance with claim 1 wherein said coating is about 3–15 μm thick.

4. A coated article in accordance with claim 1 wherein said substrate consists essentially of a tungsten carbide/binder composite including 0 to about 50 volume percent cubic carbides.

5. A coated article in accordance with claim 4 wherein said coating hard phase consists essentially of tungsten carbide.

6. A coated article in accordance with claim 1 wherein said substrate consists essentially of a monolithic or composite ceramic material and a sintering aid in an amount between 0 percent and an amount sufficient to densify said ceramic material to a preselected density.

7. A coated article in accordance with claim 6 wherein said ceramic material is based on hard refractory carbides, nitrides, or carbonitrides of titanium, zirconium, hafnium, vanadium, niobium, tantalum, chromium, or molybdenum.

8. A coated article in accordance with claim 6 wherein said ceramic material is based on silicon nitride or silicon carbide.

9. A coated article in accordance with claim 6 wherein said ceramic material is based on alumina or zirconia.

10. A coated article in accordance with claim 1 wherein the composition of said substrate and the weight percent of cobalt in said coating are each selected to tailor said wear-resistance, chemical inertness, and shape retention of said coated article to a selected one of said tribological applications.

11. A coated article for tribological applications, said article having a wear surface and comprising:

a densified substrate consisting essentially of a tungsten carbide/binder composite including 0 to about 50 volume percent cubic carbides; and a coating deposited on said substrate and providing said wear surface, said coating being about 3–15 $\mu$m thick and consisting essentially of a pore-free, dense tungsten carbide/cobalt binder composite;

wherein said wear surface includes no cubic carbides to a depth at least sufficient to avoid exposure of cubic carbides to a workpiece during use of said article in said tribological applications, such that said coated article provides wear-resistance and chemical inertness and possesses good shape retention at high machining speeds.

12. A coated cutting tool for machining titanium or titanium alloys, said article having a wear surface and comprising:

a densified substrate substantially comprising cemented carbides, cemented nitrides, cemented carbonitrides, ceramics, and combinations thereof and including 0 to about 50 volume percent cubic carbides and; and a coating deposited on said substrate and providing said wear surface, said coating being about 1–50 $\mu$m thick and comprising a pore-free, dense hard phase/cobalt binder composite, said hard phase comprising tungsten carbide, nitride, or carbonitride;

wherein said wear surface includes no cubic carbides to a depth at least sufficient to avoid exposure of cubic carbides to a workpiece during use of said article in said tribological applications, such that said coated article provides wear-resistance and chemical inertness and possesses good shape retention at high machining speeds.

13. A coated cutting tool in accordance with claim 12 wherein said substrate consists essentially of a monolithic or composite ceramic material and a sintering aid in an amount between 0 percent and an amount sufficient to densify said ceramic material to a preselected density.

14. A coated cutting tool in accordance with claim 12 wherein said substrate consists essentially of a tungsten carbide/binder composite including 0 to about 50 volume percent cubic carbides.

15. A coated cutting tool in accordance with claim 14 wherein said hard phase consists essentially of tungsten carbide.

16. A coated article in accordance with claim 12 wherein the composition of said substrate and the weight percent of cobalt in said coating are each selected to tailor said wear-resistance, chemical inertness, and shape retention of said coated article to said machining.

* * * * *